US006685548B2

(12) United States Patent
Chen et al.

(10) Patent No.: US 6,685,548 B2
(45) Date of Patent: Feb. 3, 2004

(54) GROOVED POLISHING PADS AND METHODS OF USE

(75) Inventors: Shyng-Tsong Chen, Patterson, NY (US); Kenneth M. Davis, Newburgh, NY (US); Kenneth P. Rodbell, Sandy Hook, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/424,840

(22) Filed: Apr. 29, 2003

(65) Prior Publication Data

US 2003/0199234 A1 Oct. 23, 2003

Related U.S. Application Data

(62) Division of application No. 09/668,142, filed on Sep. 25, 2000.
(60) Provisional application No. 60/214,774, filed on Jun. 29, 2000.

(51) Int. Cl.[7] ..... B24B 7/22
(52) U.S. Cl. ..... 451/526; 451/286; 451/527
(58) Field of Search ..... 451/41, 285, 286–290, 451/526, 527, 56

(56) References Cited

U.S. PATENT DOCUMENTS 5,177,908 A * 1/1993 Tuttle ..... 451/41
5,216,843 A * 6/1993 Breivogel et al. ..... 451/285
5,645,469 A * 7/1997 Burke et al. ..... 451/41
5,882,251 A * 3/1999 Berman et al. ..... 451/527
5,921,855 A * 7/1999 Osterheld et al. ..... 451/527
5,984,769 A * 11/1999 Bennett et al. ..... 451/527
6,159,088 A * 12/2000 Nakajima ..... 451/527
6,238,271 B1 * 5/2001 Cesna ..... 451/41
6,273,806 B1 * 8/2001 Bennett et al. ..... 451/527

* cited by examiner

*Primary Examiner*—Joseph J. Hail, III
*Assistant Examiner*—Anthony Ojini
(74) *Attorney, Agent, or Firm*—Connolly Bove Lodge & Hutz, LLP; Robert M. Trepp

(57) ABSTRACT

Grooves are formed in a CMP pad by positioning the pad on a supporting surface with a working surface of the pad in spaced relation opposite to a router bit and at least one projecting stop member adjacent to the router bit, an outer end portion of the bit projecting beyond the stop. When the bit is rotated, relative axial movement between the bit and the pad causes the outer end portion of the bit to cut an initial recess in the pad. Relative lateral movement between the rotating bit and the pad then forms a groove which extends laterally away from the recess and has a depth substantially the same as that of the recess. The depths of the initial recess and the groove are limited by applying a vacuum to the working surface of the pad to keep it in contact with the stop member(s). Different lateral movements between the bit and the pad are used to form a variety of groove patterns, the depths of which are precisely controlled by the stop member (s). The grooves may be formed in the polishing surface and/or the rear opposite surface of the pad and passages may be provided for interconnecting the rear grooves with the polishing surface or the front grooves.

13 Claims, 10 Drawing Sheets

GROOVED POLISHING PADS AND METHODS OF USE

This application is a divisional based off of 09/668,142 filed Sep. 25, 2000, based off of 60/214,774 filed Jun. 29, 2000.

FIELD OF THE INVENTION

The present invention relates to the field of making polishing pads, and more specifically to providing macro-textured surfaces on polishing pads used in the chemical-mechanical planarization (CMP) of semiconductor substrates.

BACKGROUND OF THE INVENTION

Chemical-mechanical polishing has been used for many years as a technique for polishing optical lenses and semiconductor wafers. More recently, chemical-mechanical polishing has been developed as a means for planarizing intermetal dielectric layers of silicon dioxide and for removing portions of conductive layers within integrated circuit devices as they are fabricated on various substrates. For example, a silicon dioxide layer may cover a metal interconnect conformably such that the upper surface of the silicon dioxide layer is characterized by a series of non-planar steps corresponding in height and width to the underlying metal interconnects.

The step height variations in the upper surface of the intermetal dielectric layer have several undesirable characteristics. Such non-planar dielectric surfaces may interfere with the optical resolution of subsequent photolithographic processing steps, making it extremely difficult to print high resolution lines. Another problem involves the step created in the coverage of a second metal layer over the intermetal dielectric layer. If the step height is relatively large, the metal coverage may be incomplete such that open circuits may be formed in the second metal layer.

To combat these problems, various techniques have been developed to planarize the upper surface of the intermetal dielectric layer. One such approach is to employ abrasive polishing to remove the protruding steps along the upper surface of the dielectric layer. According to this method, a silicon substrate wafer is mounted face down beneath a carrier and pressed between the carrier and a table or platen covered with a polishing pad that is continuously coated with a slurried abrasive material.

Means are also provided for depositing the abrasive slurry on the upper surface of the pad and for forcibly pressing the substrate wafer against the polishing pad, such that movement of the platen and the substrate wafer relative to each other in the presence of the slurry results in planarization of the contacted face of the wafer. Both the wafer and the table may be rotated relative to each other to rub away the protruding steps. This abrasive polishing process is continued until the upper surface of the dielectric layer is substantially flat.

Polishing pads may be made of a uniform material such as polyurethane or nonwoven fibers impregnated with a synthetic resin binder, or may be formed from multilayer laminations having non-uniform physical properties throughout the thickness of the pad. Polyurethane polishing pads are typically formed by placing a reactive composition in a mold, curing the composition to form the pad material, and then die cutting the pad material into the desired size and shape. The reagents that form the polyurethane or the resin binder also may be reacted within a cylindrical container.

After forming, a cylindrically shaped piece of pad material is cut into slices that are subsequently used as the polishing pad. A typical laminated pad may have a plurality of layers, such as a spongy and resilient microporous polyurethane layer laminated onto a firm but resilient supporting layer comprising a porous polyester felt with a polyurethane binder. Polishing pads typically may have a thickness in the range of 50–80 mils, preferably about 55 mils, and a diameter in the range of 10 to 36 inches, such as about 22.5 inches.

Polishing pads also may have macrotextured work surfaces made by surface machining using various techniques, many of which are expensive and produce undesirable surface features of widely varying depths. Surface features include waves, holes, creases, ridges, slits, depressions, protrusions, gaps, and recesses. Some other factors which influence the macroscopic surface texture of a polishing pad are the size, shape, and distribution frequency or spacing of the surface features. Polishing pads typically may also have microtextured surfaces cause by a microscopic bulk texture of the pad resulting from factors intrinsic to the manufacturing process. Since polishing does not normally occur across the entire pad surface, any microtexture of the pad and the macrotextures made by surface machining, may only be formed into the portion of the pad over which polishing is to take place.

During the polishing process, the material removed from the wafer surface and the abrasive, such as silica, in the slurry tend to become compacted and embedded in the recesses, pores, and other free spaces within the microscopic and macroscopic bulk texture of the polishing pad at and near its surface. One factor in achieving and maintaining a high and stable polishing rate is providing and maintaining the pad surface in a clean condition. Another factor is reducing or preventing a hydroplaning effect caused by the buildup of a layer of water between the abutting surfaces of the pad and the wafer. It has also been determined that increasing the flexibility of the pad in a controlled manner will increase polishing uniformity, i.e., the uniformity of the polished wafer surface.

Thus, consistently achieving uniform and high quality polishing of wafer surfaces by conventional pads has presented three problems. The first of these is the buildup of abrasive particles and debris between the pad and the wafer causing uneven polishing and damage to both the pad and the wafer. Secondly, uneven polishing due to hydroplaning between the wafer and the pad during conventional processes has resulted in the relatively high loss of product yield due to the resulting wafer damage. Thirdly, uneven polishing and wafer damage has also resulted from overly rigid pads produced by prior art manufacturing techniques. Therefore, there is a need for a method and apparatus for providing polishing pads capable of consistently producing high quality wafers with uniformly polished surfaces.

SUMMARY OF THE INVENTION

The present invention, therefore, provides a grooved polishing pad that is capable of consistently forming uniformly polished surfaces on high quality wafers. The apparatus for making the pad comprises a platen with positioning post for holding a polishing pad in position for engagement by a router to machine grooves in the working surface of the pad. In order to precisely control the depth of the grooves as they are routed in the pad, a spacing mechanism provides a constant and precise separation between the working surface of the pad and the chuck for holding and rotating the router.

The pad is placed on the supporting surface of the platen with its working surface in spaced relation opposite to the router bit. The router chuck and drive motor are supported opposite to the pad by a frame. The spacing mechanism comprises at least one, preferably two or more, stop members mounted on the frame adjacent to an aperture through which passes the router bit. An outer end portion of the bit projects beyond the stop member(s), which preferably are pins threaded within the frame so as to be axially adjustable. A vacuum system is provided for applying a vacuum to the working surface of the pad to pull the pad first against the outer end of the router bit and then against the stop member (s).

Rotation of the router bit by the motor while the vacuum is applied to the pad causes the outer end portion of the bit to cut an initial recess (hole) into the pad to a depth below its working surface. The recess depth is precisely limited by the stop member(s), which comes into contact with the working surface of the pad as the rotating bit cuts into the pad to form the initial recess. After formation of the initial recess, a lateral motion mechanism causes relative lateral movement between the rotating router bit and the pad while the vacuum maintains the pad in contact with the stop member(s).

This lateral movement causes the rotating bit to cut a groove in the pad extending away from the initial recess and having a depth substantially the same as the initial recess depth. The lateral motion mechanism may comprise upper and lower plates suspended from an overhead beam and arranged for relative movement in the x-y plane. For example, the upper plate may be mounted on the overhead beam and driven in the X-direction (along the X-axis) by one or more motorized screws; and the router frame suspended from the lower plate which, in turn, is mounted on the upper plate and driven in the Y-direction by one or more motorized screws. As an alternative, the platen may be similarly mounted for such x-y movement instead of the router frame, or both the platen and router frame may be mounted for such movement. In addition, the platen may be rotated by a drive motor to provide an additional means for causing lateral movement between the router bit and the pad.

It follows from the foregoing that relative movement between the stop member(s) and the pad in the Z-direction (along Z-axis) may be provided by the vacuum as it pulls the pad toward the router bit and the stop member(s). Where the polishing pad is flexible due to its large diameter and small thickness, there may be no need to guide this pad movement. Furthermore, significant pad movement along the Z-axis may be avoided by instead moving the router bit along the Z-axis, and then using the vacuum to maintain the bit depth during lateral movement between the bit and pad.

However motion of the pad along the Z-axis may be guided by a plurality, preferably two or more, posts projecting outward from the platen along axes parallel to the rotational axis of the router bit. These guideposts also may secure the pad for rotation when the platen is rotated by a platen drive motor, and are particularly useful for grooving disks other than polishing pads, such as rigid disks of greater thickness and smaller diameter. As already indicated, the upper and lower lateral motion plates provide for lateral movement of the router bit relative to the pad along the X-axis and along the Y-axis. Therefore, the router bit may be moved relative to the pad in accordance with the Cartesian coordinates x, y and z, or in accordance with the cylindrical coordinates R, θ and Z.

The foregoing relative lateral movements permit grooves cut in the polishing surface or the opposite rear surface of the pad to have either left or right spiral patterns, zigzag patterns each following a constant radius around the pad at different radii, concentric circle grooves, crisscross linear grooves, inner and outer circle grooves with spiral grooves or zigzag in areas therebetween, inner and outer sectors at different radii and having different spiral or zigzag patterns, or any combinations of these and other patterns, to provide either a uniform groove density over the polishing surface, or polishing surface sections with different groove densities. In addition, the patterned portions of the polishing surface of the pad may be confined only to those areas over which polishing of a wafer is to take place.

One purpose of cutting groove patterns in the back or rear surface of the pad is to increase its flexibility. Another purpose is to provide rear grooves connected to the front or polishing surface grooves by drilled or milled passages to thereby form outlet flow paths for draining the abrasive slurry from the polishing surface grooves.

The depth of the front and/or rear grooves may also be varied for different patterns by axially adjusting the projecting length of the stop members, which are preferably symmetrical pins, or by axially adjusting the projecting length of the router bit relative to axially fixed stop members. To provide pads of increased flexibility, the grooves may penetrate into the pad for a depth up to 80% of the pad thickness. Pad flexibility may also be adjusted by the overall number of grooves provided, such as, for example, a pattern of 8, 32, or 64 spirals.

The grooves in the working or polishing surface of a CMP pad, either alone or in combination with rear grooves, significantly reduce the hydroplaning effect during wafer polishing and, as a result, a much higher polishing rate can be achieved. A pattern with a higher number of spiral grooves can reduce the hydroplaning effect more efficiently than a pattern with a lower number of spiral grooves because more grooves will pass across the wafer surface being polished in the same period of time. An increase in pad flexibility due to the groove pattern selected may also help improve the polishing uniformity of the wafer surface. The groove density of zigzag groove patterns also may be varied to control the polishing rate distribution within different segments of the polishing pad surface and this may also improve polishing uniformity within the wafer surface.

The polishing pad provided by the present invention is ideal for polishing wafers of dielectric materials such as silicon dioxide, diamond-like carbon (DLC), spin-on-glass (SOG), polysilicon, and silicon nitride. The polishing pads also may be used to polish other wafers or disks such as those made of copper, aluminum, tungsten, and alloys of these and other metals.

BRIEF DESCRIPTION OF THE DRAWINGS

The features, operation, and advantages of the invention may be better understood from the following detailed description of the preferred embodiments taken in conjunction with the attached drawings, in which.

Figure 5:
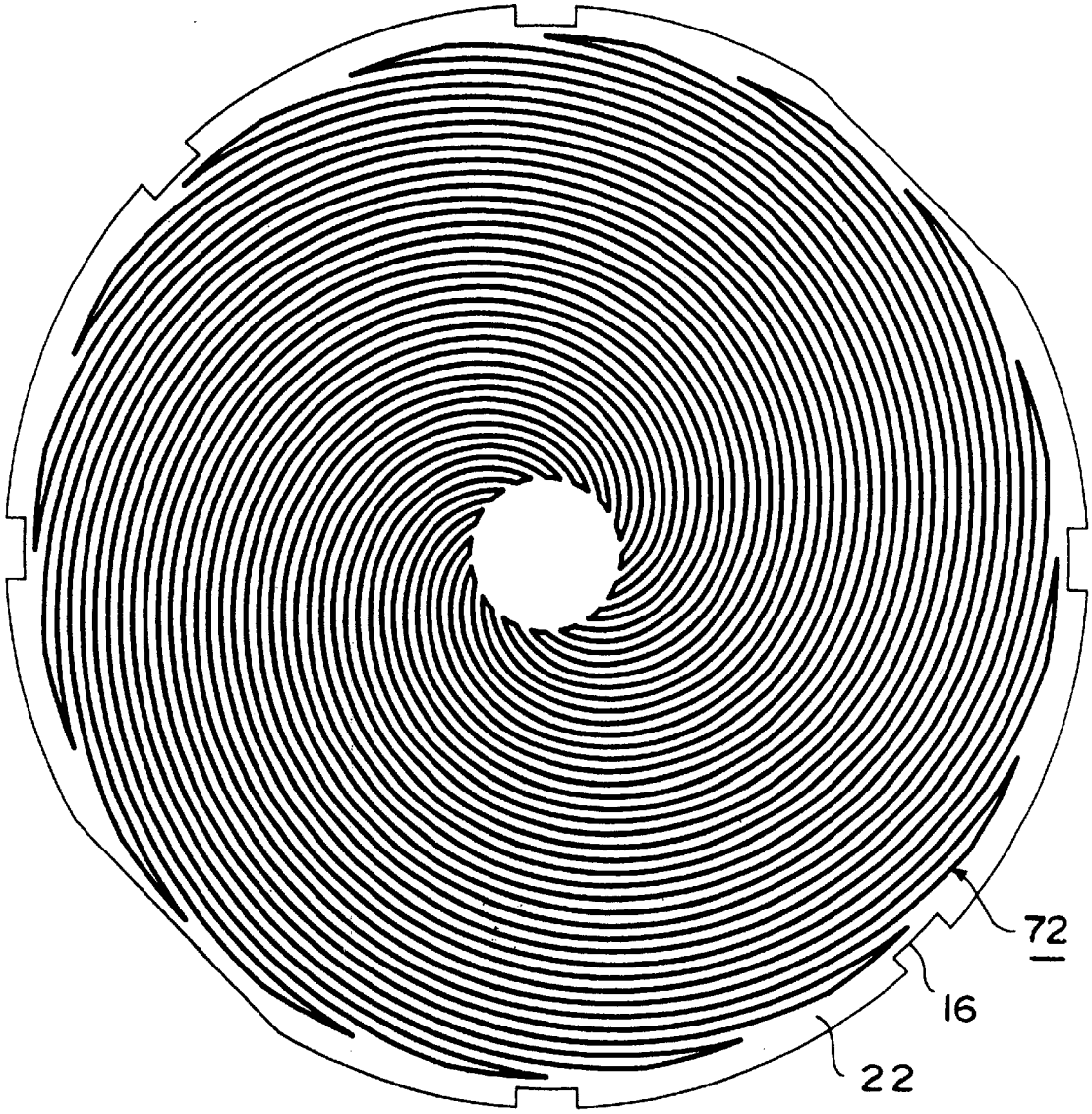
Figure 6:
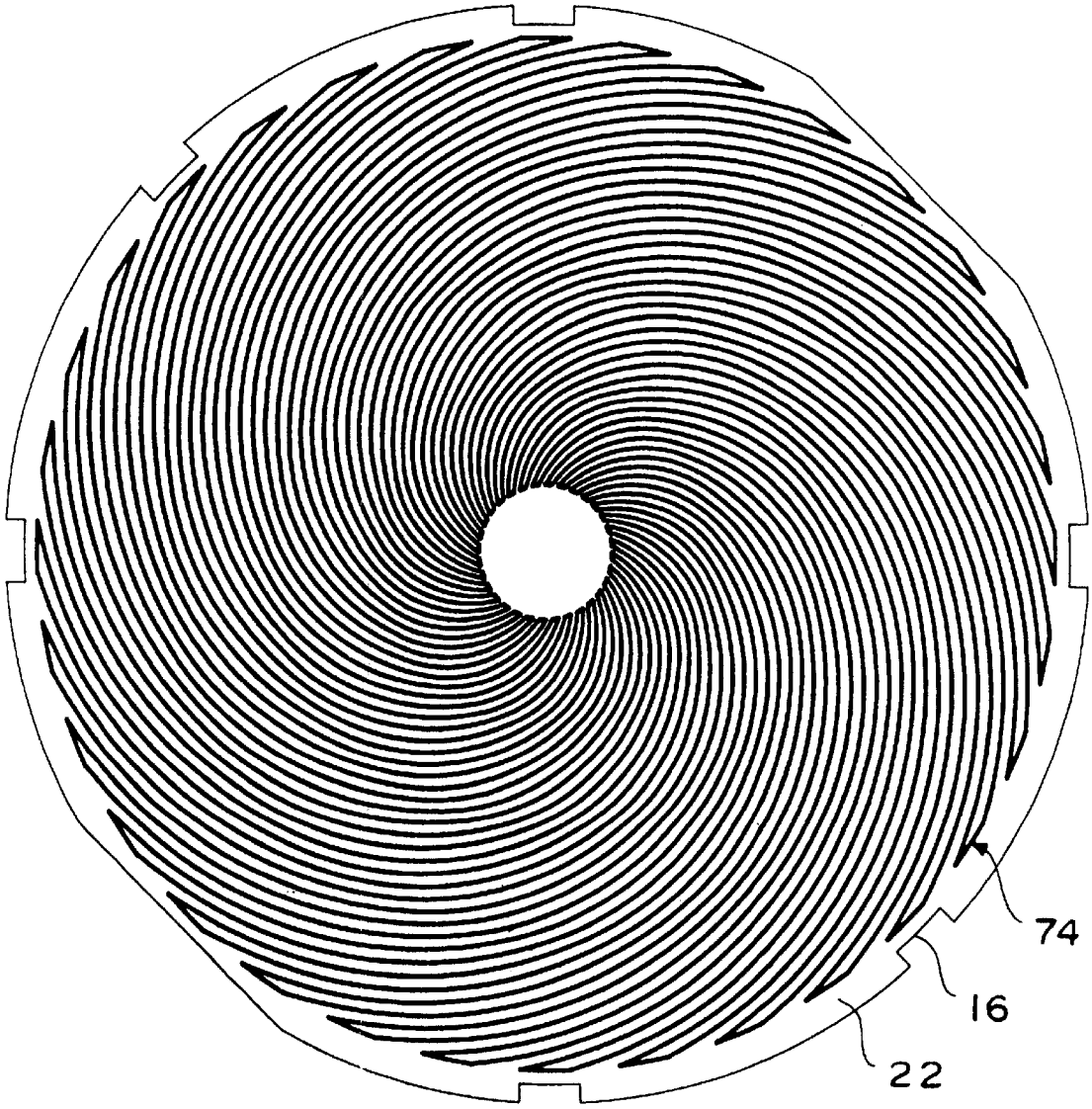
Figure 7:
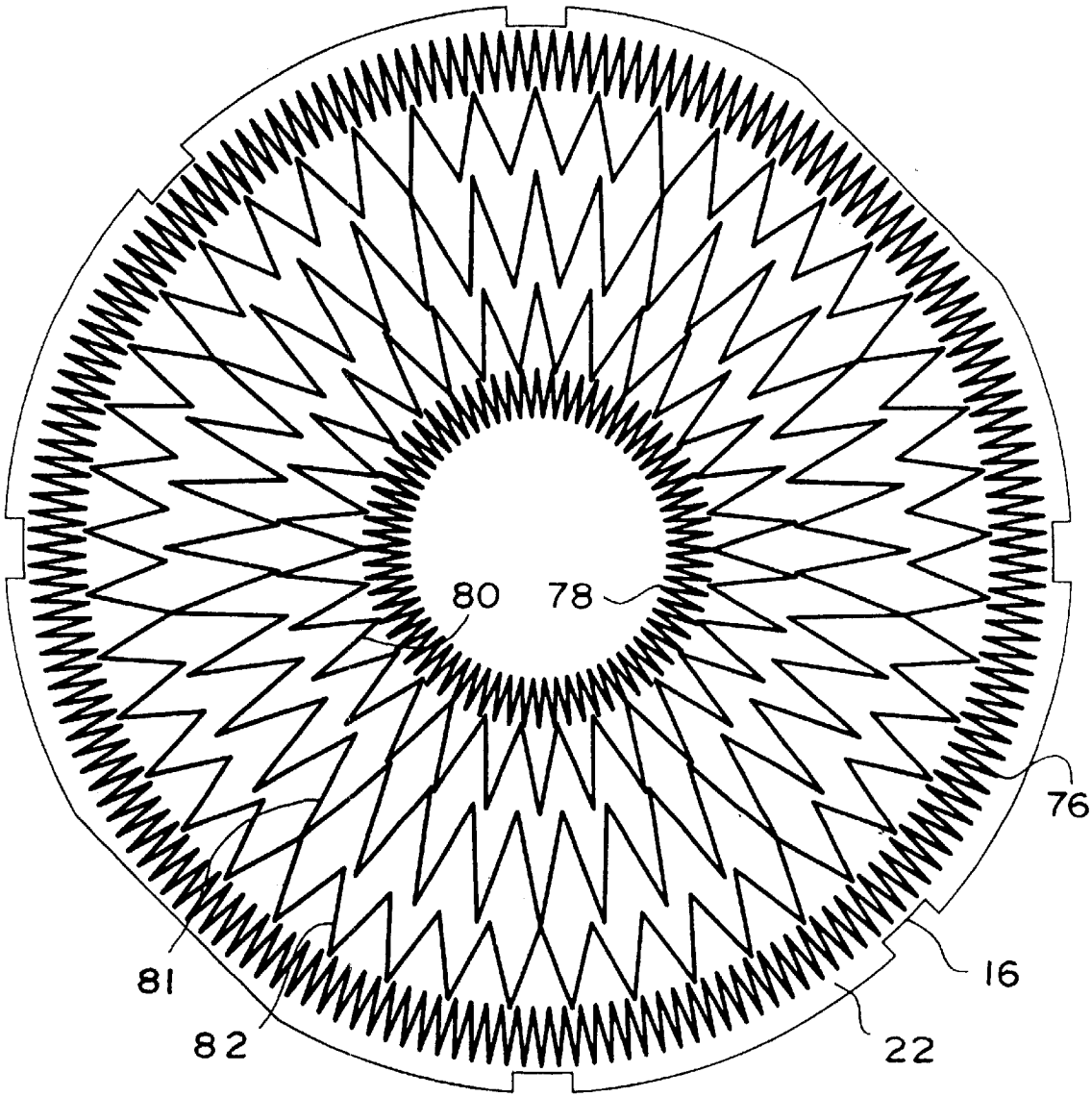
Figure 8:
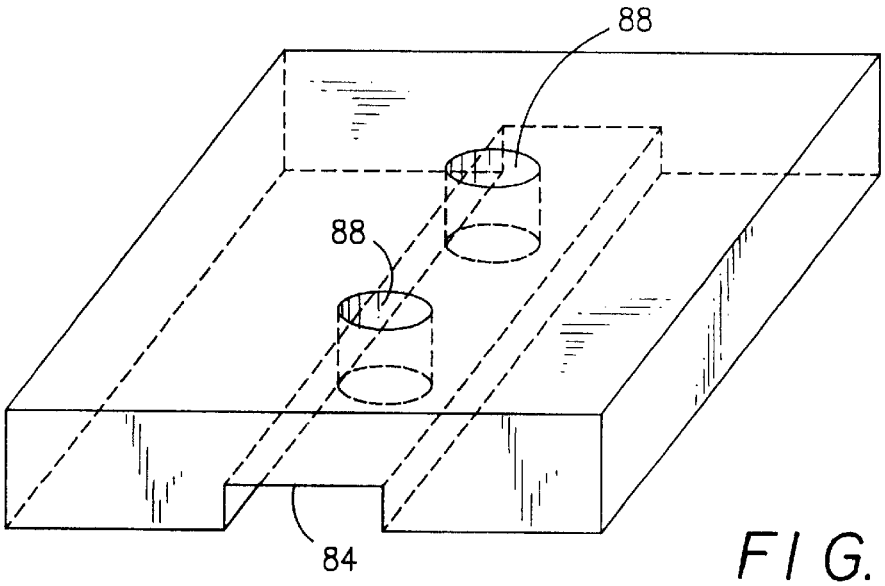
Figure 9:
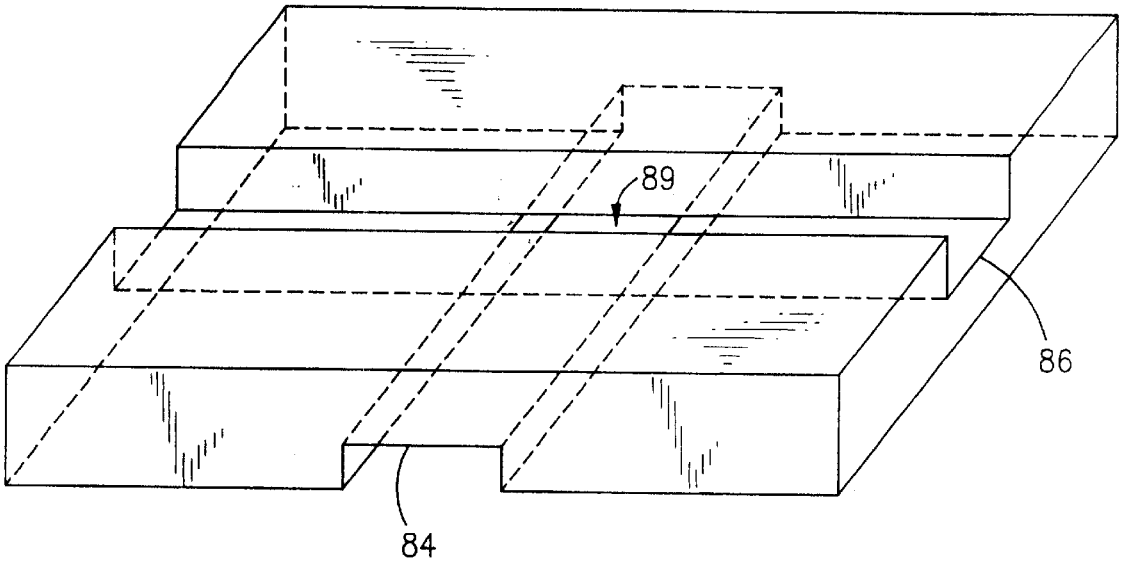
Figure 10:
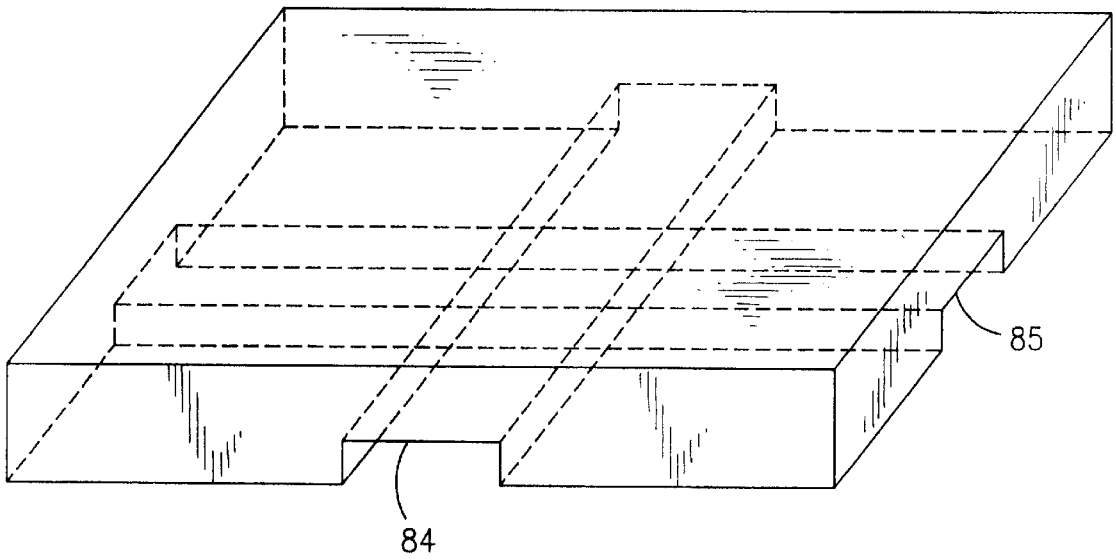
Figure 11:
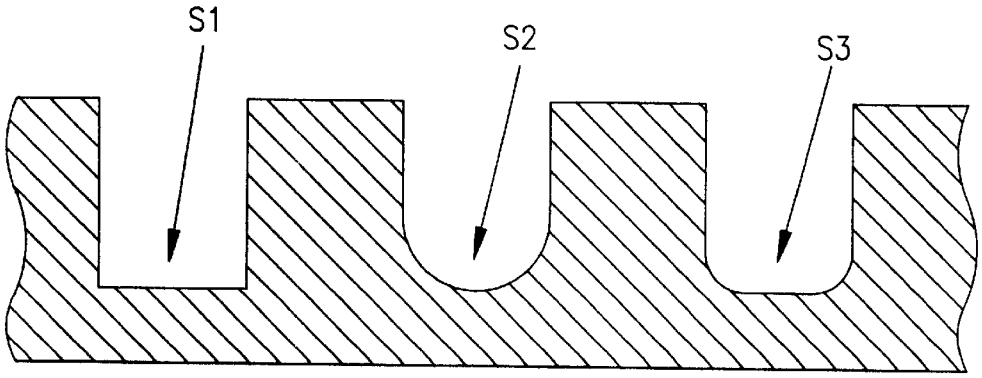
Figure 12:
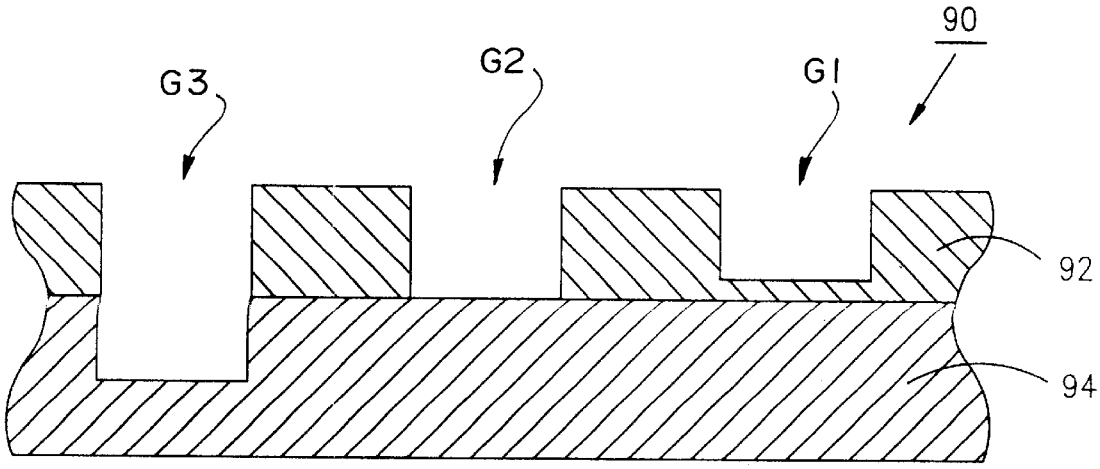
Figure 13:
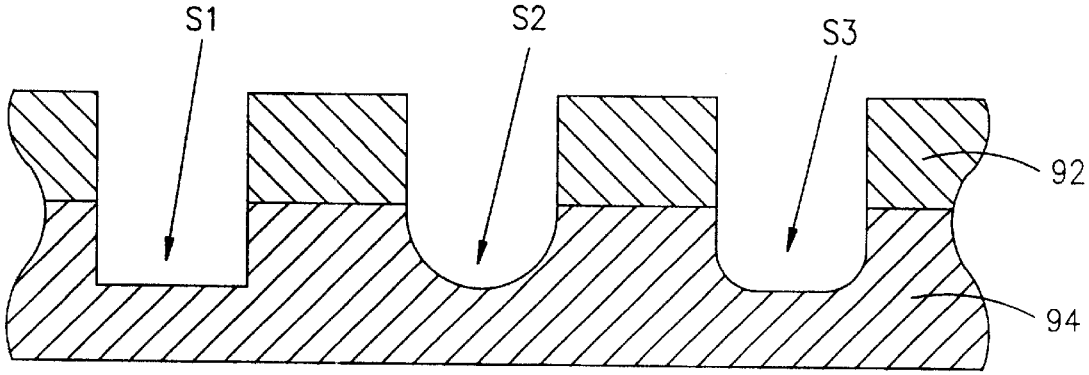
Figure 14:
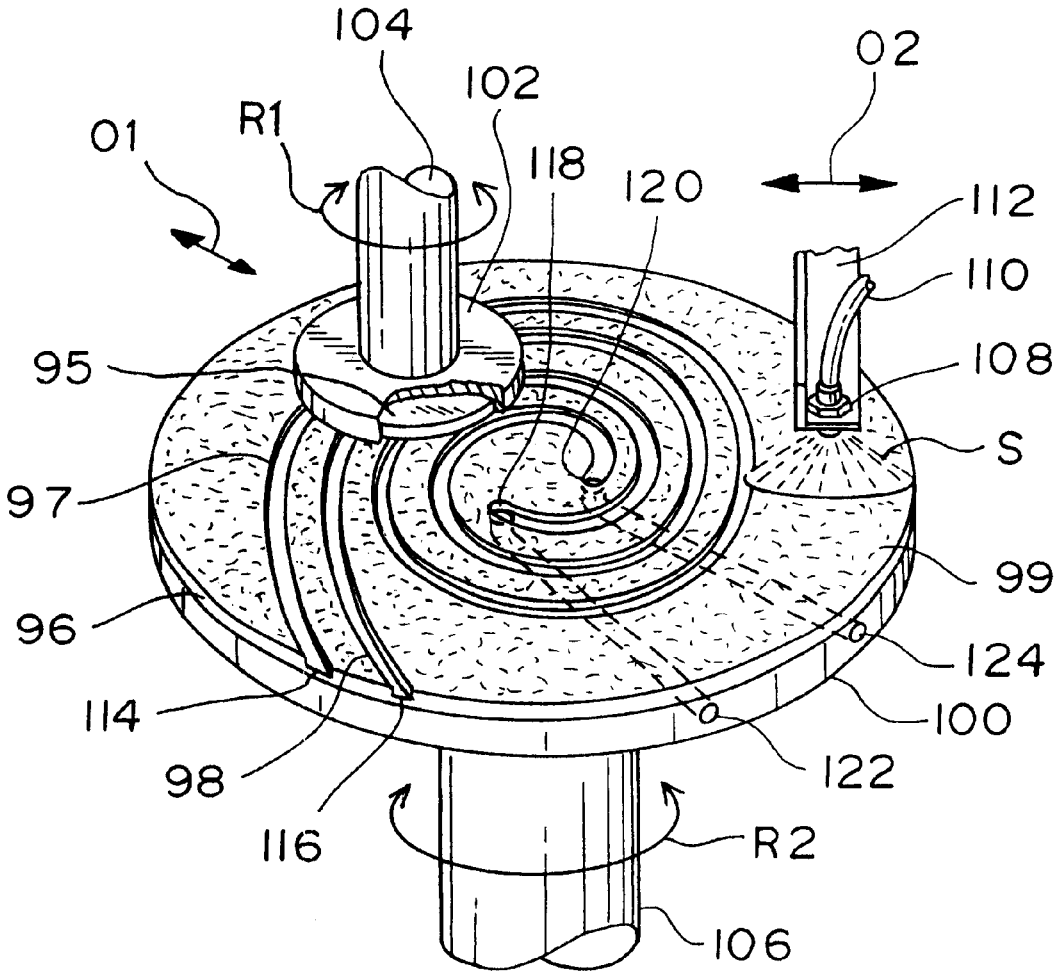

FIG. 5 shows a polishing pad made according to the present invention wherein the groove pattern comprises 32 left-hand spiral grooves beginning near the center and ending near the outer edge of the working surface of the pad;

FIG. 6 shows a polishing pad made according to the invention wherein the groove pattern comprises 64 right-hand spiral grooves beginning near the center and ending near the outer edge of the working surface of the pad;

FIG. 7 shows a polishing pad made according to the invention wherein the groove pattern comprises a plurality of radially spaced zigzag grooves each formed symmetrically along a substantially constant radius around the pad surface, and wherein the groove density of the innermost and outermost grooves are varied from each other and from intermediate grooves;

FIG. 8 illustrates diagrammatically a backside groove interconnected by a passage to a non-grooved portion of the polishing surface of a pad;

FIG. 9 illustrates diagrammatically a backside groove interconnected by a passage to a front side groove of the polishing surface of a pad;

FIG. 10 illustrates diagrammatically crisscrossed grooves on the backside of a polishing pad;

FIG. 11 illustrates diagrammatically different cross-sectional shapes for the grooves in the polishing surface of a pad made of a single layer of uniform material;

FIG. 12 illustrates diagrammatically grooves of different depths in the polishing surface of a composite pad made from a top pad of one material and a subpad of another material;

FIG. 13 illustrates diagrammatically different cross-sectional shapes for the grooves in the polishing surface of a composite pad made from a top pad of one material and a subpad of another material; and, FIG. 14 illustrates a method of polishing a workpiece with a grooved pad made in accordance with the invention.

DETAILED DESCRIPTION OF THE PREFERRED EMBODIMENTS

Figure 2:
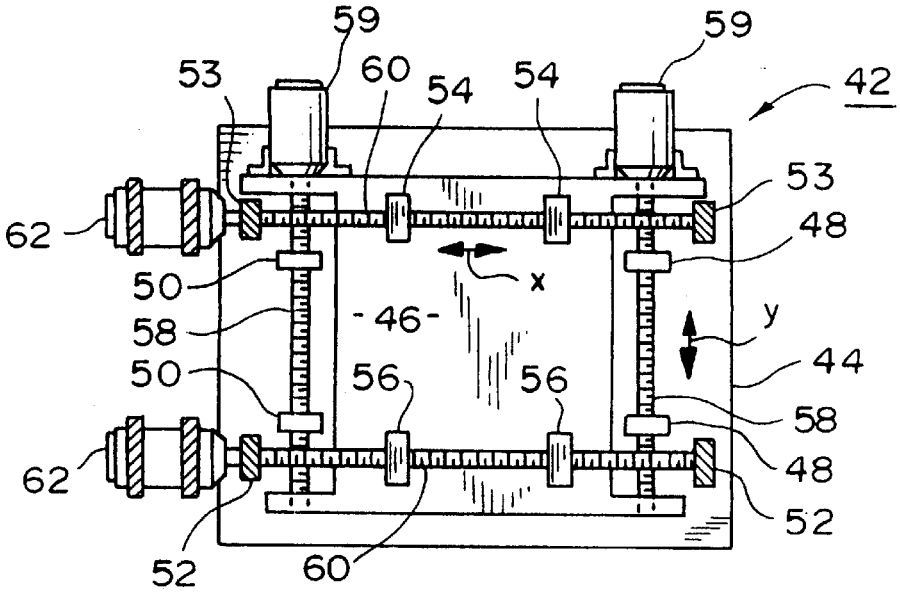
FIG. 2 is a planar cross-sectional view as taken along line 2—2 of FIG. 1.
Figure 1:
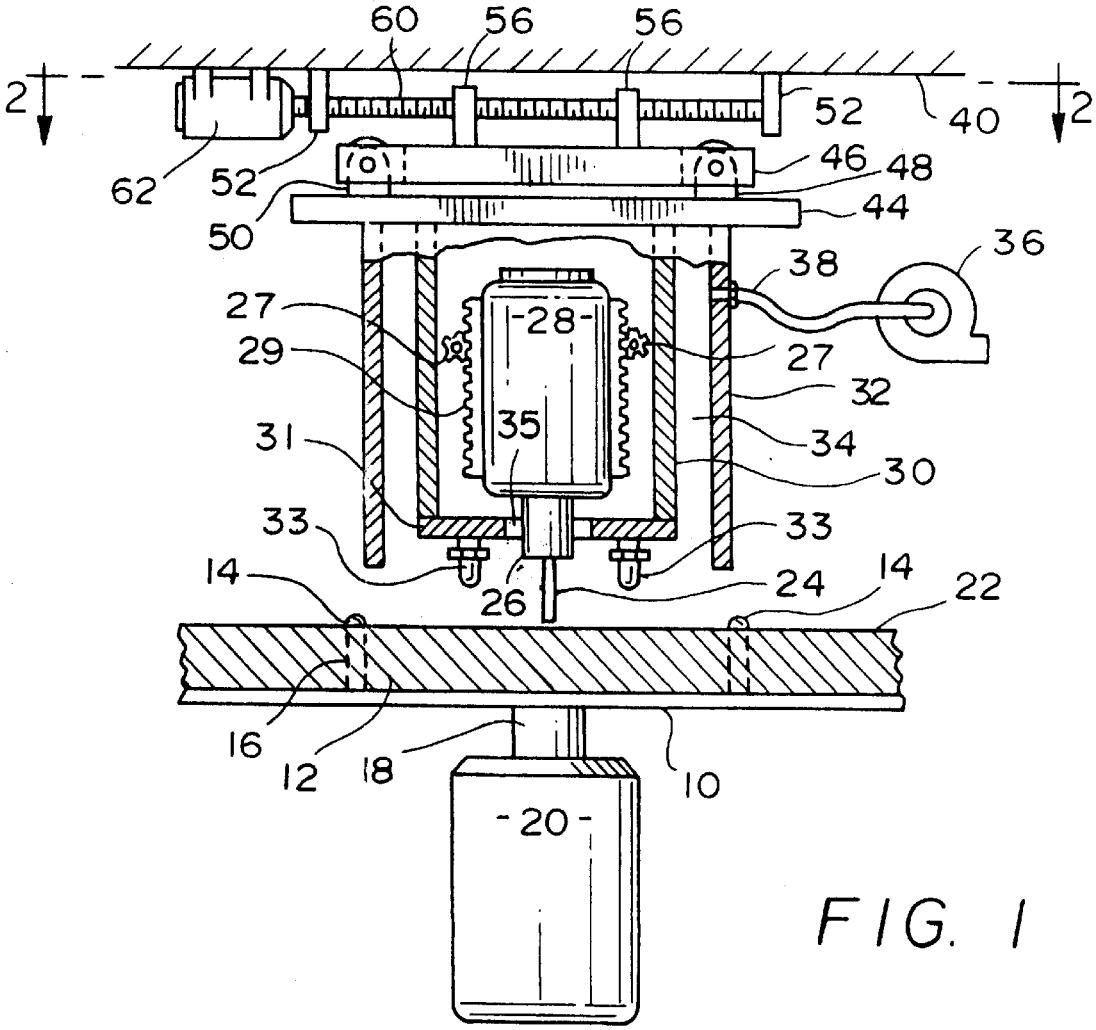
FIG. 1 is an elevational view of the invention in partial section and in which its major components are illustrated diagrammatically.
Figure 3:
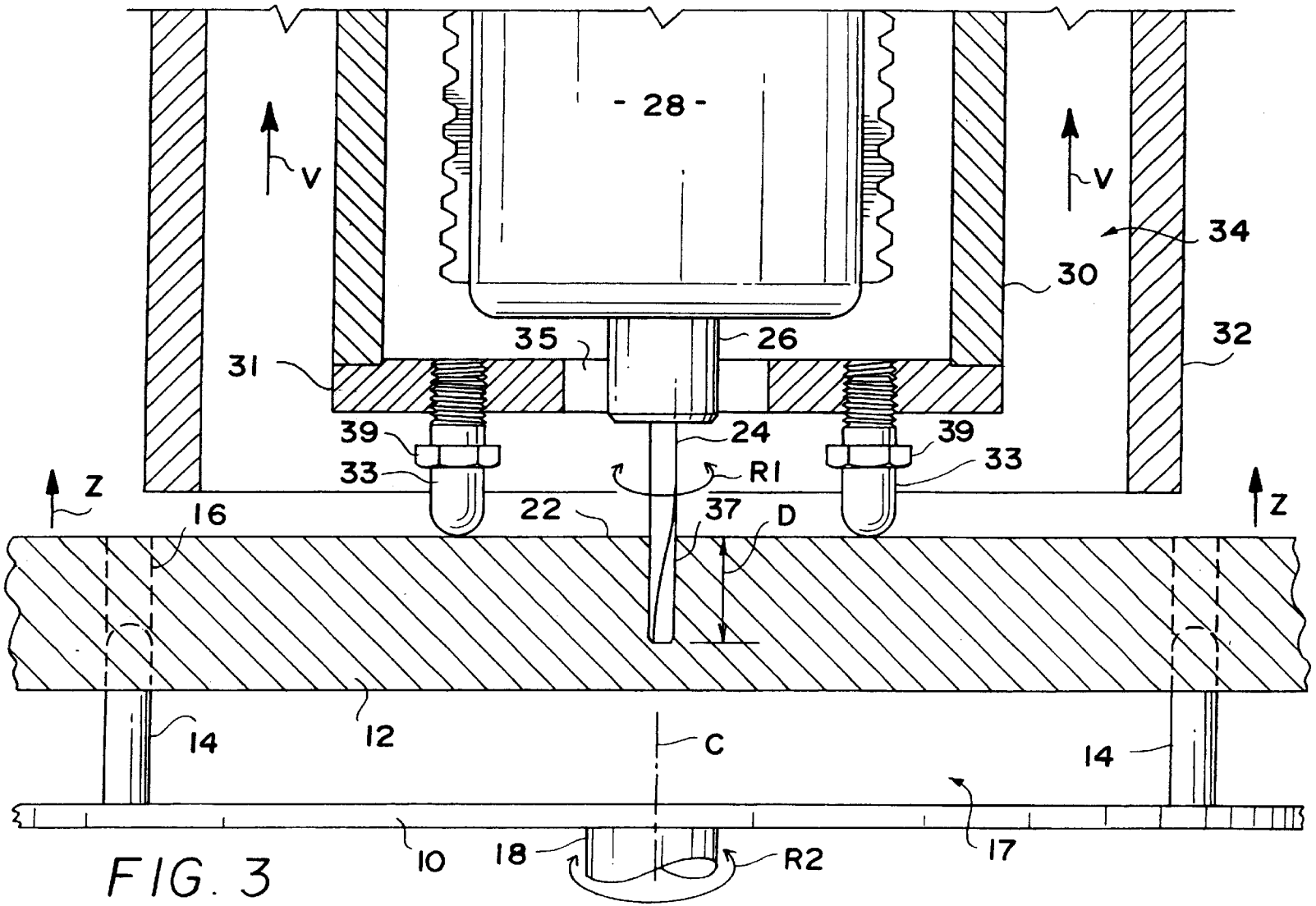
FIG. 3 is an enlarged partial sectional view of a portion of FIG. 1.
Figure 4:
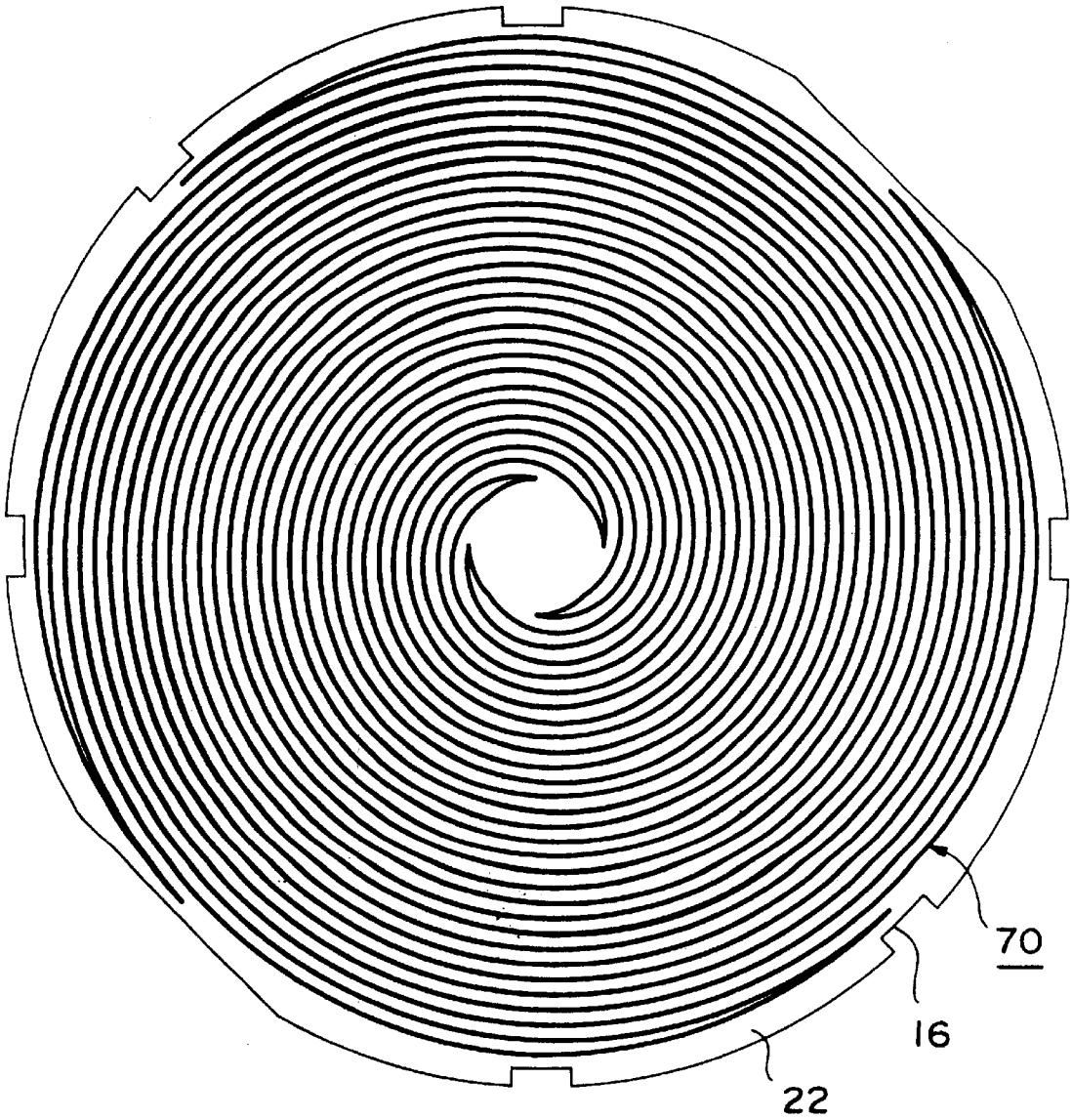
FIG. 4 shows a polishing pad made according to the present invention wherein the groove pattern comprises 8 left-hand spiral grooves beginning near the center of the pad and ending near the outer edge of the working surface of the pad.

The polishing pad grooving method and apparatus of the present invention are illustrated best in FIGS. 1–3. The polishing apparatus has a platen 10 on which a polishing pad 12 is supported and held in a fixed radial position by a plurality of holding posts 14. Each of the holding posts 14 fits within a channel or recess 16 (FIG. 4) formed within the pad body or in the pad periphery and extending parallel to the central axis C of the pad so that the pad may be guided for axial movement away from the surface of the platen, as illustrated by the arrows Z and the air gap 17 shown in FIG. 3. However, for axially adjustable routers and/or flexible pads of sufficiently large diameter and small thickness to permit movement of the portion thereof being grooved, the holding posts 14 may be replaced by non-guiding clamps.

Positioned opposite to the working surface 22 of pad 12 is a router bit 24 replaceably held in a chuck 26 and driven in rotation by a router motor 28. Router motor 28 is carried by a frame 30 surrounded by a casing 32, such that an annular space 34 is provided between the concentric walls of the frame and the casing, both of which are preferably cylindrical. A vacuum, represented by arrows V, V is provided in the annular space 34 by a blower 36 attached to the casing 32 by a flexible hose 38. The platen 10 is carried for rotation in either direction by a drive shaft 18 driven by a platen motor 20. Motors 20 and 28 may both be of the reversible type, such that the router bit 24 may be rotated in either direction, as indicated by the arrow R1, and the platen 10 also may be rotated in either direction, as indicated by the arrow R2.

Mounted on the bottom wall 31 of the frame 30 adjacent to a passage 35 for the router bit 24 is a plurality of stop pins 33, which project parallel to the router bit for a distance that is less than the projecting distance of the router bit itself. The difference between the projecting distance of the pins 33 and the projecting distance of the router bit define the length of an end portion 37 of the bit equal to the desired depth of the groove to be cut by this end portion, as described more fully below in connection with operation of the invention. The projecting length of bit end portion 37 may be changed by rotating a pair of pinions 27, 27 that engage a corresponding pair of racks 29, 29 mounted on router motor 28 as shown in FIG. 1. The pins 33 are preferably threaded into the bottom wall 31 for axial adjustment, as an alternative means for changing the projecting length of bit end portion 37. Pins 33 may have a hex head portion 39 permitting engagement for rotation by a corresponding tool.

The router is mounted to an overhead support or carrying member 40 by a lateral motion mechanism, generally designated 42, to provide for lateral movement of the router bit in an x-y plane perpendicular to the axis of router bit rotation and the corresponding central axis C of the polishing pad. The lateral motion mechanism 42 may be any structure providing precise lateral movement of the router 24 in the x-y plane, and may not be needed in instances where the router support member 40 is itself movable in the x-y plane, such as where the member 40 is attached to or part of a precisely controllable robotic arm.

By way of example, the motion device illustrated in FIGS. 1 and 2 comprises a lower plate 44 suspended from an upper plate 46 by two pairs of threaded eyelets 48, 48 and 50, 50. In turn, the upper plate 46 is suspended from two pairs of brackets 52, 52 and 53, 53 by another two pair of threaded eyelets 54, 54 and 56, 56. Each eyelet pair 48, 48 and 50, 50 is threadedly engaged by a corresponding drive screw 58 driven in rotation by a reversible y-axis motor 59 to provide reciprocal motion of lower plate 44 along the y-axis, as illustrated by the double-ended arrow Y. Similarly, the eyelet pairs 54, 54, and 56, 56 are each threadedly engaged by a corresponding drive screw 60 rotated by a reversible x-axis electric motor 62 to provide reciprocal motion of upper plate 46 along the x-axis, as illustrated by the double-ended arrow X in FIG. 2.

Operation of the pad grooving apparatus will now be described with reference to FIGS. 1–3. The blower 36 is turned on to generate a vacuum V in the annular passage 34. This vacuum generates an upward force in the direction of arrows Z, Z to uplift and/or hold the pad 12 against the axially adjustable stop pins 33, which are thereby used to control the groove depth. The router bit 24 extends beyond the ends of stop pins 33 by the length of bit end portion 37, and will cut into the pad 12 when the bit is rotated by turning on the router motor 28. The router is preferably turned on and vertically adjusted after the vacuum is applied. Any upward movement of the pad, in response to the vacuum V, is guided by the engagement between the holding posts 14 and corresponding recesses or channels 16, which may be in the body or the periphery of the pad 12. The end portion 37 of the bit 24 may project beyond the tips of pins 33 by a length of up to 80% of the pad thickness, such that the end portion of the bit may penetrate to a depth up to 80% of the thickness of the pad. The projecting length of bit end portion 37 may be changed to thereby change the groove depth by turning the pinions 27, 27 or by turning the pins 33, 33, or by a combination of these adjustments After the router bit 24 has penetrated fully into the pad, as determined by abutment between the tips of stop pins 33 and the working surface 22 of pad 12, the bit is then moved radially relative to the pad in an x-y plane, as illustrated by the double-end arrows X and Y in FIG. 2. This x-y movement may be achieved solely by moving the lower plate 44 and the upper plate 46 relative to each other by operation of the motors 59 and 62, or these lateral movements may be combined with rotation of the platen 10 about the center axis C, while the router bit 24 is moved in a radial direction to form spiral grooves.

Lateral movement of the lower plate 44 along the y-axis is produced by the rotation of screws 58, 58 in threaded engagement with the respective eyes 48, 48 and 50, 50. Lateral movement of the upper plate 46 along the x-axis is produced by rotation of screws 60, 60 in threaded engagement with the eyes 54, 54 and 56, 56. Rotation of the platen 10 is provided by rotation of the shaft 18 by platen motor 20. Accordingly, the router bit 24 may be moved laterally in the x, y plane in the Cartesian coordinates x, y, or in the cylindrical coordinates R, θ with respect to the polishing pad 12. In addition, the router bit may be moved up and down along the Z-axis in both Cartesian and cylindrical coordinates by either hand or motorized rotation of the pinions 27 by conventional mechanisms that are not seen.

Upward movement along the z-axis in both Cartesian and cylindrical coordinates is also provided by movement of the pad 12 away from the surface 22 of platen 10 and against the tips of pins 33 in response to the creation of vacuum within annular passage 34. The pad moves downward along the z-axis when the vacuum ceases upon stopping blower 36. Such movement of the pad 12 along the z-axis is therefore produced by the pressure differential across the pad thickness as generated by the vacuum V. As an alternative, a pressure differential for causing such pad movement could be generated by ejecting pressurized air under the pad through a series of air holes or nozzles (not shown).

Thus, the spiral grooves formed by the present invention preferably (but not necessarily) start from the center of the pad and end near the outer edge thereof. The direction of the spiral pattern can either be to the left, as shown by the eight spiral grooves in FIG. 4 and the 32 spiral grooves in FIG. 5, or to the right, as illustrated by the 64 spiral grooves in FIG. 6. In FIGS. 4–7, the grooves are represented by heavy solid black lines for clarity because the opposing edges of the actual grooves are too close to be shown as double lines. As careful examination will reveal, a single continuous groove forms the pattern 70 of FIG. 4, the pattern 72 of FIG. 5, and the pattern 74 of FIG. 6, such that, once inserted, the router bit does not have to be withdrawn until the pattern is completed.

The spiral grooves in the surface of the pad will reduce the hydroplaning effect during polishing and, as a result, a much higher polishing rate can be achieved. A higher number of spiral grooves within the same surface area can reduce the hydroplaning effect more efficiently than a lower number of spiral grooves because in the same period of time more grooves will pass across the surface of a wafer pressed against the pad surface during polishing of the former. It follows from this that the rate of removal of the slurried abrasive, which is used in combination with the pad for wafer polishing, will be greater the higher number of the spiral grooves per unit area of the pad working surface. A high number of grooves can also make the pad more flexible, which can help improve the uniformity of wafer polishing.

FIG. 7 illustrates a zigzag groove pattern consisting of an outer groove 76, an inner groove 78, and three intermediate grooves 80, 81, and 82. These grooves are made separately by stopping the blower to withdraw the bit from the pad, repositioning the bit laterally relative to the pad, and then restarting the blower to insert the bit into the pad. However, the grooves 76, 78, 80, 81, and 82 could be interconnected, in which case the pattern could instead be made by a single continuous groove to eliminate intermediate withdrawals of the bit from the pad. The groove pattern of FIG. 7 illustrates that the groove density may be varied over different portions of the pad surface. Such variations in groove density can be used to control the polishing rate distribution in accordance with where a wafer is pressed against the polishing pad surface, and this, too, can help improve the uniformity of wafer polishing. For generating the patterns shown in FIGS. 4–7 and other complex groove patterns, the positioning motors 20, 59, and 62 are preferably controlled by a microprocessor (not shown).

Polishing uniformity is typically controlled by varying parameters such as wafer rotation rate, polish pad rotation rate or polishing belt speed, or the polishing compressive force generated by varying pressure from behind the wafer or from beneath the pad or belt, or by varying other tool parameters. Other variables affecting polishing uniformity include the properties of the consumables (i.e., the pads, sub-pads and slurries).

For using slurries with a pad or belt, the size and type of abrasive particles (e.g., different phases and morphologies of alumina, ceria or silica particles) may be varied to obtain different polish rates and planarization rates. Chemical additives may be added to the slurry in order to keep the abrasive particles suspended, to enhance the polish rate, to change the relative polish rates of different materials and to protect the polished workpiece from scratching and corrosion. The mix of chemicals and abrasives in the polish slurry can have an effect on polishing uniformity by making the polish fast at the wafer edge and slow at the center or vice versa. Often key parameters such as the selectivity between the polish rates of different materials play an overriding role in slurry design and may cause the degree of polishing uniformity to be fixed. Moreover, it is nearly impossible to develop and run slightly different slurry compositions which are optimized for the different polishing tool sets currently being used in industry.

For pads and sub-pads, the hardness and porosity of the pads are the most commonly control properties relating to polishing uniformity. Often there are also perforations, grooves or indentations distributed across the pad surface to help ensure the uniform distribution of slurry to the wafer surface during polishing in an attempt to get uniform polish removal rates everywhere on the wafer. In the case of pad grooving, all patterns in use to date are uniform patterns of equally spaced straight lines, concentric circles or grid patterns.

The present invention varies the groove density across the pad in order to improve polishing uniformity. The effects on polishing uniformity of varying groove pattern density are described below. Increasing the density of grooves in the polishing surface of the polishing pad in one region compared to another region allows more slurry to be distributed to the higher groove density regions than to the lower groove density regions. Thus, higher polish removal rates may be realized in high groove density regions than in low groove density regions. Such non-uniform groove densities on pads can compensate for lack of polishing uniformity due to deficiencies of polish tools and slurries, and can even compensate for pre-polish films of non-uniform thickness or prior non-uniform polishing rates. For example, wafers with an initial film thickness which is edge thick and center thin may be polished to a uniform thickness across the wafer by using a pad similar to that of FIG. 7 where the groove density is highest at the edge and center of the pad (i.e., at the inner and outer edges of the wafer track during polishing).

Alternatively, a pad with a higher density of grooves in the center as compared to the edge would have a faster polish rate in the center and would thus compensate for films with thicker center profiles. Moreover, this concept of varying groove density across a pad may be applied to linear polishing belts or pads and to different groove patterns and shapes. Other possible groove patterns include, but are not limited to, a single continuous spiral groove similar to those shown in FIGS. 4–6, but where the spacing between adjacent spirals are changed in different regions of the pad in order to achieve different groove densities; or concentric circles (or straight lines in the case of a belt-style polishing pad) which are finely spaced in some regions and coarsely spaced in other regions of the pad.

Varying the groove pattern density also may affect properties of the polishing pad. As shown in FIGS. 8 and 9, respectively, the grooves 84 can be added to the backside of the pad alone or in combination with front side grooves 86. Backside only grooves 84 and 85, as shown in FIG. 10, may be done to increase the flexibility of the pad if, for example, a front side groove is not desirable. The grooves on the backside of the pad can also communicate to the front of the pad with the use of one or more holes 88 through the pad (FIG. 8) to relieve wafer suction or as a method for passing air, a gas, or a fluid or combination of these from the backside of the pad to the front surface. In addition, holes or openings from the backside to the front side grooves may be used as receptacles for probes capable of detecting the end point or completion of the polishing process, or a minimum groove depth indicating excessive wear of the pad. Such holes or other openings also may be used without backside grooves, and instead be aligned with drainage holes or passages in the platen supporting the pad. The grooves on a backside of the pad can communicate with grooves on the polishing side through one or more openings 89 to relieve wafer suction as shown in FIG. 9, such as where the top side groove is close ended. This is an important consideration since wafer suction may prevent removal of a wafer from the polishing pad when the CMP step is completed. A shot of air or fluid through the communicating passage from the backside will allow for the timely removal of the wafer from the polishing pad.

Additionally, the bottoms of the front side and backside grooves can be made with a half circular shape S2 or a rounded corner shape S3, instead of a rectangular shape S1, as shown in FIGS. 11 and 13, to make it more difficult for polishing debris to accumulate inside the groove and/or to facilitate cleaning debris from the groove. To optimize the flexibility of a pad having a composite body 90, the depth of the grooves can be less than or equal to or more than the thickness of a top pad 92 adhered to or otherwise secured on the upper surface of a subpad 94. With respect to FIG. 13, it is also contemplated that the subpad 94 or an intermediate layer between the pad 92 and the subpad 94 may be of a color different from that of pad 92 to provide a means in situ for determining a minimum degree of pad wear acceptable for keeping the pad in polishing service. Alternatively, a bottom colored portion of any of the grooves, or a bottom color indicator of various types on or near the groove bottom could be provided for this purpose. To optimize the polishing uniformity and minimize the hydroplaning effect, the groove can be continuous (open ended) or segmented into one or more closed-end sequential segments.

The descriptions above relate to methods for optimizing the performance of CMP polishing pads. When these optimized pads are combined with selected slurries of the appropriate abrasive particle size, pH, etc., a further improved CMP polishing process for metal and dielectric films may be realized. To further optimize the polishing process, the body of the pad may be made from solid or porous organic material such as polyurethane that is very durable because it is strongly cross linked, or made from a fibrous organic material such as at least one of rayon and polyester fibers and this material may also contain a binder as well as solid or porous polyurethane.

FIG. 14 is an illustration of polishing a wafer 95 with a slurry S and a polishing pad 96 having two spiral grooves 97 and 98, the pad 96 being attached to a platen 100. Above the polishing pad 96 is a holder 102 for carrying the wafer 95 and pressing it against the polishing surface 99 of the polishing pad 96. During polishing, the holder 102 may be rotated by a drive shaft 104 and the platen 100 may be rotated by drive shaft 106. The holder 102 and the platen 100 may rotate either clockwise or counterclockwise as indicated by the arrows R1 and R2, and the holder 102 may either rotate in the same direction as the platen 100, or in the opposite direction. Preferably, both the holder 102 and the platen 100 are rotated in the same direction as the direction of a spiral groove from its inner end to its outer end, such as counterclockwise according to the grooves shown in FIG. 14. As also shown in FIG. 14, the grooves 97 and 98 have outlets (open ends) 114 and 116, the pad 96 has holes 118 and 120 at the inner groove ends, and platen 100 has fluid passages 122 and 124 for providing flow pathways for draining slurry from the grooves.

While the holder and platen are rotated, the holder 102 may be oscillated back and forth across the polishing pad as indicated by the arrow O1. A slurry of abrasive particles is deposited on the polishing surface 99 as a spray S discharged by a nozzle 108 supplied by a hose 110. The nozzle 108 is mounted on an oscillating member 112 so that the spray S may also be oscillated back and forth across the polishing pad as indicated by the arrow O2.

Traditionally, CMP has involved the development of separate polishing slurries each with a different abrasive such as W, $SiO_2$, Al or Cu and separate polishing pads for each type of wafer or other workpiece material. One of the main drawbacks to this approach is the dependence of CMP on both the chemical reaction between the slurry and the workpiece and the mechanical interaction between the pad, the slurry and the workpiece. This has led to the development of the grooved polishing pads of the present invention to improve the slurry flow to and from the polishing surface of the pad and to prevent undesirable mechanical effects such as hydroplaning in which the pad and workpiece being polished slide past each other with little friction, resulting in no effective polishing rate.

The present invention also combines the use of particular slurry and grooved polishing pad combinations in order to enhance the polishing rates of various materials and to improve polishing uniformity. By choosing a particular slurry/pad combination, one can effectively enhance the polishing process by enhancing the flow of slurry to and from the material being polished, as well as enhancing the mechanical friction by avoiding regions of hydroplaning.

The use of grooved polyurethane based pads and silica based slurries for oxide wafer polishing is one such example. Another example is grooved pads made from binder and/or polyurethane impregnated fibers and used with alumina based slurries for Cu and W metal polishing. To avoid tearing of composite pads made from natural or synthetic soft fibers, the use of polyurethane coated fibers was found to allow for both pad conditioning and grooving. Thus, by combining the optimum polishing chemistry for a particular workpiece material with the grooved pads of the invention, a substantial polishing rate and polishing uniformity advantage is gained.

Persons skilled in the art, upon learning of the present disclosure, will recognize that various changes and modifications to the elements and steps of the invention are possible without significantly affecting their functions. For example, the support structures for the pad and for the router, the nature and shape of the stop members for controlling the depth of the grooves, the arrangement for applying a pressure differential for holding the pad against the stop members, and the structures for providing relative lateral movement between the router bit and the pad, all as described above by way of example, may be varied widely in accordance with current and future technology for providing the functions of these systems and components. For example, the platen may include an array of air passages and outlets for providing a cushion of pressurized air under the pad to provide all or part of the pressure differential for holding the pad against the stop members. Also, in addition to being rotated, both the platen and the pad may be moved in an x-y plane by mounting the platen drive motor on a lateral movement mechanism similar to mechanism 42 for mounting the router motor as described above. Further combinations of front and/or back groove patterns, depths and/or shapes in addition to those described above, and other types of fluid passages in the pad and/or its supporting platen, may also be desirable. Accordingly, while the preferred embodiments have been shown and described above in detail by way of example, further modifications and embodiments are possible without departing from the scope of the invention as defined by the claims set forth below.

What is claimed is:

1. A polishing pad comprising:

a body having a substantially flat polishing surface; and at least one groove disposed in said polishing surface, wherein upon a rotation of the pad, said at least one groove sweeps over a total workpiece surface in contact with the pad, and wherein said at least one groove is disposed in a pattern so as to provide a variable groove along a radius of said pad.

2. A polishing pad, according to claim 1, wherein said at least one groove is a spiral groove.

3. A polishing pad, according to claim 2, wherein said pad has at least eight spiral grooves.

4. A polishing pad, according to claim 2, wherein said pad has at least thirty two spiral grooves.

5. A polishing pad, according to claim 2, wherein said pad has at least sixty four spiral grooves.

6. A polishing pad, according to claim 1, wherein said at least one groove is a zig-zag groove centered about a circular arc radially disposed from a center of said pad.

7. A polishing pad according to claim 6, wherein said pad has at least four zig-zag grooves.

8. A polishing pad, according to claim 6, wherein said pad has at least eight zig-zag grooves.

9. A polishing pad, according to claim 1, further comprising means disposed in said groove for determining a degree of wear of said polishing surface.

10. A polishing pad, according to claim 1, wherein a bottom surface of said at least one groove is disposed to permit debris to be removed therefrom.

11. A polishing pad comprising:

a body having a substantially flat polishing surface;

at least one groove disposed in said polishing surface, wherein upon a rotation of the pad, said at least one groove sweeps over a total workpiece surface in contact wit the pad, and wherein said at least one groove is disposed in a pattern so as to provide a variable groove density along a radius of said pad;

at least one backside substantially parallel to said frontside, wherein at least one backside groove is arranged in said backside; and at least one fluid passage connecting said at least one backside groove to said at least one polishing groove.

12. A polishing pad, according to claim 11, wherein said at least one groove is a spiral groove.

13. A polishing pad, according to claim 11, wherein said at least one groove is a zig-zag groove centered about a circular arc radially disposed from a center of said pad.

* * * * *